United States Patent [19]

Zocher

[11] 4,075,959

[45] Feb. 28, 1978

[54] PNEUMATIC THREAD AND FIBER FEEDING DEVICES

[75] Inventor: Josef Zocher, Aachen, Haaren, Germany

[73] Assignee: The Singer Company, New York, N.Y.

[21] Appl. No.: 785,266

[22] Filed: Apr. 6, 1977

[51] Int. Cl.[2] ..... D05B 87/00

[52] U.S. Cl. ..... 112/225

[58] Field of Search ..... 112/225, DIG. 1, DIG. 2, 112/DIG. 3; 223/99

[56] References Cited

U.S. PATENT DOCUMENTS 3,508,690 4/1970 Pozzolo ..... 223/99

3,763,804 10/1973 Reich ..... 112/225

*Primary Examiner*—George H. Krizmanich

*Attorney, Agent, or Firm*—Robert E. Smith; Edward L. Bell; Julian Falk

[57] ABSTRACT

A device which introduces compressed air at an angle to thread placed in a split tube. When this split tube is placed adjacent to the eye of a sewing needle, the compressed air will shift the thread through the tube and thence through the needle eye. The split is provided in the tube to allow the device to be removed from the thread after the needle has been threaded. Frictioning means may be included for holding the thread in the tube until the compressed air is introduced.

4 Claims, 5 Drawing Figures

PNEUMATIC THREAD AND FIBER FEEDING DEVICES

BACKGROUND OF THE DISCLOSURE

In any sewing operation, one of the most tedious tasks is the threading of the sewing needle. Methods presently in use are, among others, manually inserting the thread through the sewing needle eye or by first passing a loop of fine wire through the needle eye, passing the thread through the loop of wire, and then drawing the loop along with the thread back through the needle eye.

SUMMARY OF THE INVENTION

The object of this invention is to provide a device that will automatically thread a sewing needle eye. This object is achieved by placing the thread in a split tube and bringing the end of the tube adjacent to the eye of the sewing needle. By impinging the thread within the tube with compressed air angled toward the needle eye, the thread will be caused to shift axially in the tube and to thence pass through the sewing needle eye.

A funnel may be used in combination with the pneumatic thread feeding tube, and releasable thread frictioning means may be incorporated to prevent accidental movement of the thread in the split tube.

DESCRIPTION OF THE PREFERRED EMBODIMENT

Figure 1:
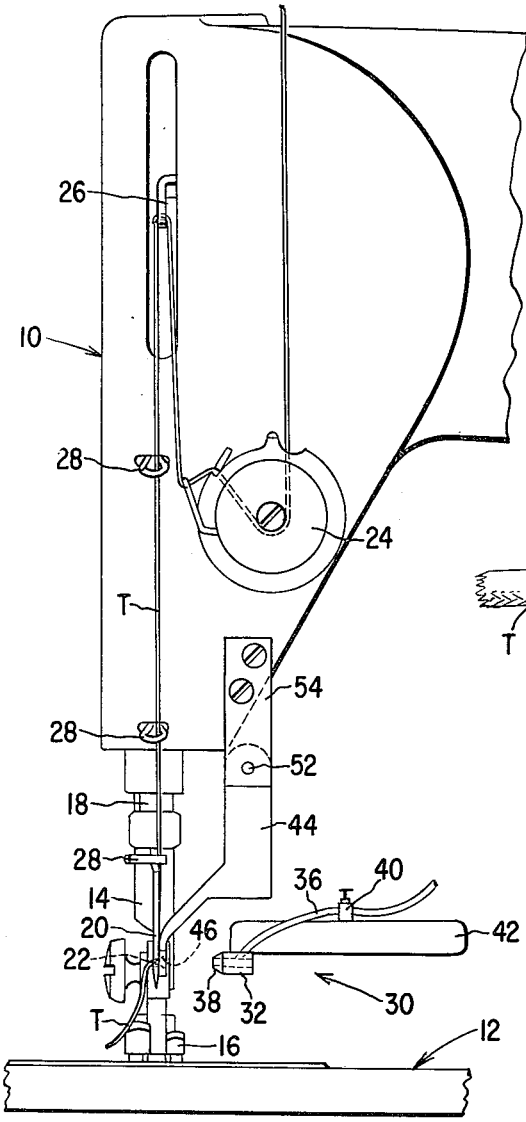
FIG. 1 is a front elevational view of a sewing machine with the needle threader of this invention in close proximity thereto.
Figure 2:
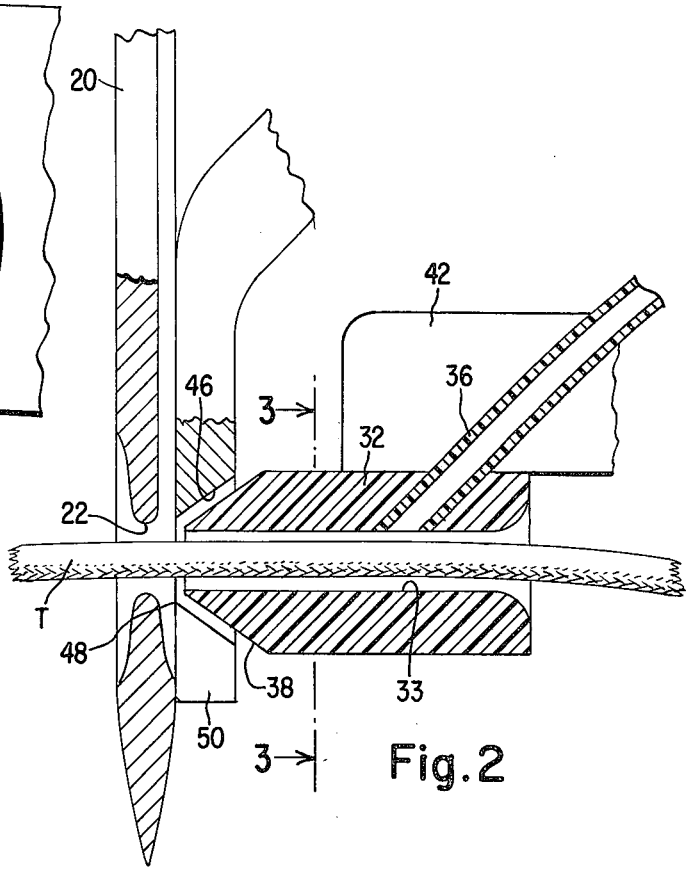
FIG. 2 is an enlarged front elevation partly in section of the needle threader in use.
Figure 3:
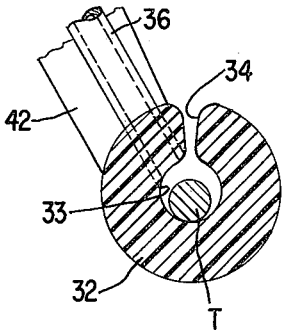
FIG. 3 is a cross-section of the needle threader taken substantially along line 3—3 in FIG. 2.

With reference to the drawing of the invention in FIG. 1, there is shown a fragment of a sewing machine casing including a sewing head 10 and a portion of a sewing machine bed 12. Included in the sewing head is a presser bar 14 to the end of which is attached a presser foot 16. Also included in the sewing head is a needle bar 18 arranged for endwise reciprocation and a sewing needle 20 attached to the end of the needle bar 18. In FIG. 1 the needle is illustrated in the upper most extremity of its endwise reciprocatory path of motion. The sewing needle 20 is provided with a thread carrying eye 22 through which a thread T must be passed. The thread T is shown passing through a tension device 24, through a thread take-up 26, through various thread guides 28, and then through the sewing eye 22.

The thread feeding device 30 of this invention includes a thread carrying member in the form of a tube 32 having an inside passageway 33 preferrably dimensioned to the size of the thread to be fed. The tube 32 is formed with a longitudinal slit 34 for both easing the introduction of thread T into the tube and for enabling removal of the thread T from the device 30 after the thread T has been fed through the needle eye. In close proximity to the slit 34, a conduit 36 radially intersects the tube 32 obliquely at an angle, preferrably 45°, from the longitudinal axis of the tube 32 in a direction toward the delivery end 38 of the split tube 32. Compressed air is delivered to the split tube 32 through conduit 36 and is regulated by a valve 40. The valve 40 and the split tube 32 are shown attached to a handle 42 to enable the device 30 to be used with one hand of an operator.

A funnel guide 44 is provided to aid in the use of the thread feeding device 30. The funnel guide 44 extends downward to a point adjacent to the sewing needle 20. At the end of the funnel guide 44 is a tapered hole 46 having a small end 48 the same size as and adjacent to the sewing needle eye 22, when the sewing needle 20 is in its upper extreme position. The delivery end 38 of the tube 32 is so tapered as to engage the tapered hole 46 of the guide 44. The guide 44 is provided with a radial split 50 to enable removal of thread T after the needle 20 is threaded. The guide 44 is pivotably attached at 52 to a bracket 54 which is attached to the sewing head 10 such that, after use, the guide 44 may be pivoted out of the way.

If, however, the funnel guide 44 on the machine casing is arranged so that when retracted the tapered hole 46 occupies a position in the regular path of the thread T to the needle, the tapered hole may be made closed and the thread T can remain in the tapered hole during subsequent sewing operations.

Figure 4A:
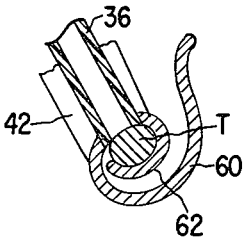
FIGS. 4A and 4B show a modified form of the needle threader of this invention in which the split tube is replaced by a spiral construction which frictionally holds the thread in place until compressed air is admitted and opens on introduction of the compressed air.
Figure 4B:
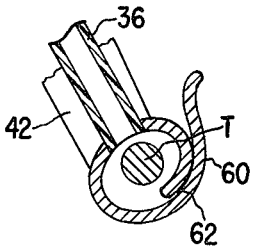

A second embodiment of the thread feeding device 30, as shown in FIGS. 4A and 4B, involves replacing the tube 32 with a scroll 60 shaped of flexible sheet metal. The scroll 60 has an inner convolution 62 which in its free state will frictionally grasp thread T placed therein. When compressed air is applied through conduit 36, the inner convolution 62 will be urged out of engagement with the thread T allowing the thread T to shift axially in the scroll 60 and through the needle eye 22.

Having set forth the nature of this invention, what is claimed herein is:

1. A device for feeding thread through the eye of a thread carrying needle comprising, a thread guide member formed with a delivery extremity shaped substantially complemental to the eye portion of a thread carrying needle, said thread carrying member being formed lengthwise with a thread accommodating passageway, a constricted slot formed the entire length of said thread accommodating passageway and extending radially from said passageway to the exterior of said thread carrying member, a compressed air delivery conduit opening onto said thread accommodating passageway and extending obliquely toward the delivery extremity thereof, and an operator influenced valve means in said compressed air delivery conduit for controlling the compressed air which propels a thread lengthwise through said thread accommodating passageway when the delivery extremity is positioned complemental to the needle eye for threading the needle.

2. A device as set forth in claim 1 in which said thread carrying member includes a means for frictionally engaging and impeding lengthwise movement of a thread in said thread accommodating passageway, and means effective upon delivery of compressed air into said thread accommodating passageway from said compressed air delivery conduit for releasing the thread from said frictionally engaging means.

3. A device as set forth in claim 1 in which said thread carrying member comprises a scroll shaped strip of flexible sheet metal including an inner convolution defining the thread accommodating passageway and arranged frictionally to engage a thread therein to impede lengthwise movement of the thread along the passageway, said inner convolution of said scroll projecting laterally across the opening of said compressed air delivery conduit so as to be urged out of frictional engagement with the thread upon delivery of compressed air from said conduit into said passageway.

4. In a sewing machine having a casing and a thread carrying needle endwise reciprocable in said casing between extreme elevated and work penetrating positions, a needle threader comprising: a member formed with a funnel carried on said casing and having a position in which said funnel is in alignment with the needle eye in the extreme elevated position of the needle, a thread carrying member formed with a delivery extremity shaped substantially complemental to the funnel, said thread carrying member being formed lengthwise with a thread accommodating passageway, a constricted slot formed the entire length of said thread accommodating passageway and extending radially from said passageway to the exterior of said thread carrying member, a compressed air delivery conduit opening onto said thread accommodating passageway and extending obliquely toward the delivery extremity thereof, and an operator influenced valve means in said compressed air delivery conduit for controlling the lengthwise propulsion of a thread in said thread accommodating passageway when the delivery extremity is positioned complemental to the funnel.

* * * * *